US007005809B2

(12) United States Patent
Whitham et al.

(10) Patent No.: US 7,005,809 B2
(45) Date of Patent: Feb. 28, 2006

(54) ENERGY SWITCH FOR PARTICLE ACCELERATOR

(75) Inventors: Kenneth Whitham, Alamo, CA (US); Xiaodong Ding, Hercules, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 10/723,944

(22) Filed: Nov. 26, 2003

(65) Prior Publication Data

US 2005/0110440 A1 May 26, 2005

(51) Int. Cl.
*H05H 7/00* (2006.01)

(52) U.S. Cl. ..... 315/500; 315/506; 315/5.21

(58) Field of Classification Search ..... 315/500–506, 315/5.21, 5.41, 5.46, 3.5
See application file for complete search history.

(56) References Cited

U.S. PATENT DOCUMENTS 4,024,426 A * 5/1977 Vaguine ..... 315/5.41
4,122,373 A * 10/1978 Vaguine ..... 315/5.41
4,286,192 A * 8/1981 Tanabe et al. ..... 315/5.41
4,629,938 A * 12/1986 Whitham ..... 315/5.41
5,821,694 A * 10/1998 Young ..... 315/5.41
6,407,505 B1 * 6/2002 Bertsche ..... 315/5.41
6,465,957 B1 * 10/2002 Whitham et al. ..... 315/5.41
6,493,424 B1 * 12/2002 Whitham ..... 378/137

* cited by examiner

*Primary Examiner*—Trinh Vo Dinh

(57) ABSTRACT

Some embodiments include operation of an accelerator waveguide to output first particles from a tuned end cavity of the accelerator waveguide at a first energy, detuning of the end cavity, and operation of the accelerator waveguide to output second particles from the detuned end cavity at a second energy.

26 Claims, 8 Drawing Sheets

ENERGY SWITCH FOR PARTICLE ACCELERATOR

BACKGROUND

1. Field

The present invention relates generally to particle accelerators. More particularly, embodiments of the present invention relate to particle accelerators designed to output particles at various energies.

2. Description

A particle accelerator produces charged particles having particular energies. In one common application, a particle accelerator produces a radiation beam used for medical radiation therapy. The beam may be directed toward a target area of a patient in order to destroy cells within the target area.

A conventional particle accelerator includes a particle source, an accelerator waveguide and a microwave power source. The particle source may comprise an electron gun that generates and transmits electrons to the waveguide. The waveguide receives electromagnetic waves from the microwave power source, which may comprise as a magnetron or a klystron. The electrons are accelerated through the waveguide by oscillations of the electromagnetic waves within cavities of the waveguide.

The accelerating portion of the waveguide includes cavities that are designed to ensure synchrony between electrons received from the particle source and the oscillating electromagnetic wave received from the microwave power source. More particularly, the cavities are carefully designed and fabricated so that electric currents flowing on their surfaces generate electric fields that are suitable to accelerate the electron bunches. The oscillation of these electric fields within each cavity is delayed with respect to an upstream cavity so that a particle is further accelerated as it arrives at each cavity.

A particle accelerator is usually designed to output particles within a limited range of output energies. Due to the number of factors that interact during operation, a conventional particle accelerator cannot efficiently provide particle energies outside of this small window. As described above, these interacting factors include, but are not limited to: the magnitude of an electron current produced by the particle source; the frequency and energy of the electromagnetic wave; shape, the construction and resonant frequency of the accelerator waveguide cavities; and the desired output energy.

Some conventional particle accelerators attempt to efficiently output particles having widely-varying energies. One system uses a shunt to "short out" a portion of the accelerator waveguide and to therefore reduce particle acceleration based on a desired output energy. Another system includes two separate waveguide sections with RF phase adjustment for selectively accelerating electrons based on a desired output energy. Neither of these current accelerator structures is seen to provide efficient operation at substantially different output energies.

SUMMARY

In order to address the foregoing, some embodiments provide a system, method, apparatus, and means to operate an accelerator waveguide to output first particles from a tuned end cavity of the accelerator waveguide at a first energy, to detune the end cavity, and to operate the accelerator waveguide to output second particles from the detuned end cavity at a second energy. According to further aspects, detuning the end cavity comprises changing a resonant frequency of the end cavity.

Some embodiments provide an accelerator waveguide comprising an end cavity, the accelerator waveguide to output first particles from the end cavity at a first energy in a first mode and to output second particles from the end cavity at a second energy in a second mode, and a detuning device coupled to the end cavity. According to some embodiments, the detuning device may include a probe movable between a first position in the first mode and a second position within the end cavity in the second mode. A detuning device according to some embodiments may include an electrical circuit including an electrical conductor, a portion of the electrical conductor disposed within the end cavity.

The claimed invention is not limited to the disclosed embodiments, however, as those of ordinary skill in the art can readily adapt the teachings herein to create other embodiments and applications.

BRIEF DESCRIPTION OF THE DRAWINGS

Embodiments of the claimed invention will become readily apparent from consideration of the following specification as illustrated in the accompanying drawings, in which like reference numerals designate like parts, and wherein:

DETAILED DESCRIPTION

The following description is provided to enable any person of ordinary skill in the art to make and use embodiments of the claimed invention and sets forth the best mode contemplated by the inventors for carrying out the claimed invention. Various modifications, however, will remain readily apparent to those in the art.

Figure 1:
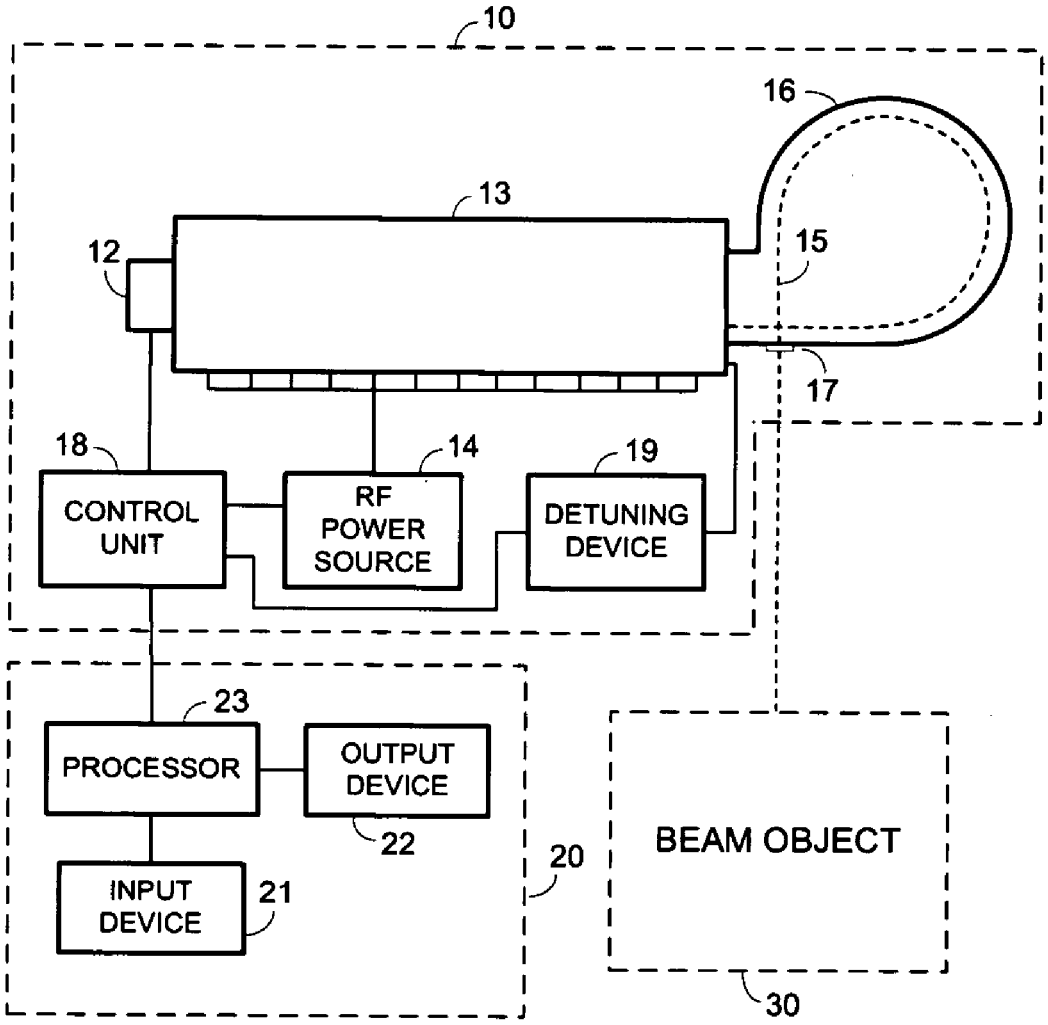
FIG. 1 is block diagram depicting a particle accelerator system according to some embodiments.

FIG. 1 illustrates a system according to some embodiments. The system includes particle accelerator 10, operator console 20 and beam object 30.

Particle accelerator 10 may be used to output particles toward beam object 30 in response to commands received from operator console 20. According to some embodiments, the output particles have a first energy when particle accelerator 10 is operated in a first mode and have a second energy when particle accelerator 10 is operated in a second mode.

Particle accelerator 10 includes particle source 12 for injecting particles such as electrons into accelerator waveguide 13. Particle source 12 may comprise a heater, a thermionic cathode, a control grid, a focus electrode and an anode. Accelerator waveguide 13 may include a "buncher" section of cavities that operate to bunch the electrons and a second set of cavities to accelerate the bunched electrons. Some embodiments of particle accelerator 10 may include a prebuncher for receiving particles from particle source 12 and for bunching the electrons before the electrons are received by accelerator waveguide 13. RF power source 14 may comprise a magnetron or Klystron coupled to the cavities of accelerator waveguide 13 in order to provide an electromagnetic wave thereto.

In one example of operation according to some embodiments, accelerator waveguide 13 receives an electromagnetic wave from RF power source 14 and electrons from particle source 12. The buncher section prepares the electrons for subsequent acceleration by a second portion of waveguide 13. In particular, the buncher may include tapered cavity lengths and apertures so that the phase velocity and field strength of the received electromagnetic wave begin low at the input of the buncher and increase to values that are characteristic to the accelerating portion. Typically, the characteristic phase velocity is equal to the velocity of light. As a result, the electrons gain energy and are bunched toward a common phase as they travel through the buncher.

Accelerator waveguide 13 outputs beam 15 to bending magnet 16. Beam 15 includes a stream of electron bunches having a particular energy and bending magnet 16 comprises an evacuated envelope to bend beam 15 270 degrees before beam 15 exits bending magnet 16 through window 17. Beam 15 is received by beam object 30, which may comprise a patient, a target for generating bremsstrahlung photon radiation, or another object.

Control unit 18 controls an injection voltage and beam current of particle source 12, and a frequency and power of the electromagnetic wave based on operator instructions and/or feedback from elements of particle accelerator 10 and/or another system. Control unit 18 also controls detuning device 19. Detuning device 19 is coupled to an end cavity of accelerator waveguide 13 and may be used to detune the end cavity. Detuning the end cavity may change boundary conditions of the electric field within waveguide 13 and therefore change the total accelerative force imparted to particles by waveguide 13.

Detuning device 19 comprises any one or more elements operable to detune the end cavity. Such elements may be operable to change a resonant frequency of the end cavity. In some embodiments, detuning device 19 comprises an electrical circuit including an electrical conductor. The electrical conductor may be coupled to the end cavity and the end cavity may be detuned by changing a characteristic of the electrical circuit. Detuning device 19 may comprise a probe and a motor for moving the probe from a first position to a second position within the end cavity. Further details of detuning device 19 and its operation according to some embodiments are set forth below.

Operator console 20 includes input device 21 for receiving instructions from an operator and processor 22 for responding to the instructions. Operator console 20 communicates with the operator via output device 22, which may be a monitor for presenting operational parameters and/or a control interface of particle accelerator 10. Output device 22 may also present images of beam object 30 to confirm proper delivery of beam 15 thereto.

In one example of operation according to some embodiments, an operator issues a command to output a 14 MeV beam using input device 21. Processor 22 transmits the command to control unit 18, which in turn sets a grid voltage of particle source 12 to generate a beam current corresponding to the desired output energy. Control unit 18 also sets a power of the wave emitted by RF power source 14 based on the desired energy. As a result, particle accelerator 10 outputs particles at the desired energy.

After the particles have been output, the operator may issue a command to output a 7 MeV beam. Processor 22 again transmits the command to control unit 18, which changes the beam current and/or the RF wave power to correspond to the newly-desired energy. Moreover, control unit 18 controls detuning device 19 to detune an end cavity of accelerator waveguide 13. Particles are thereafter output from the end cavity of waveguide 13 at the newly-desired energy.

Figure 2:
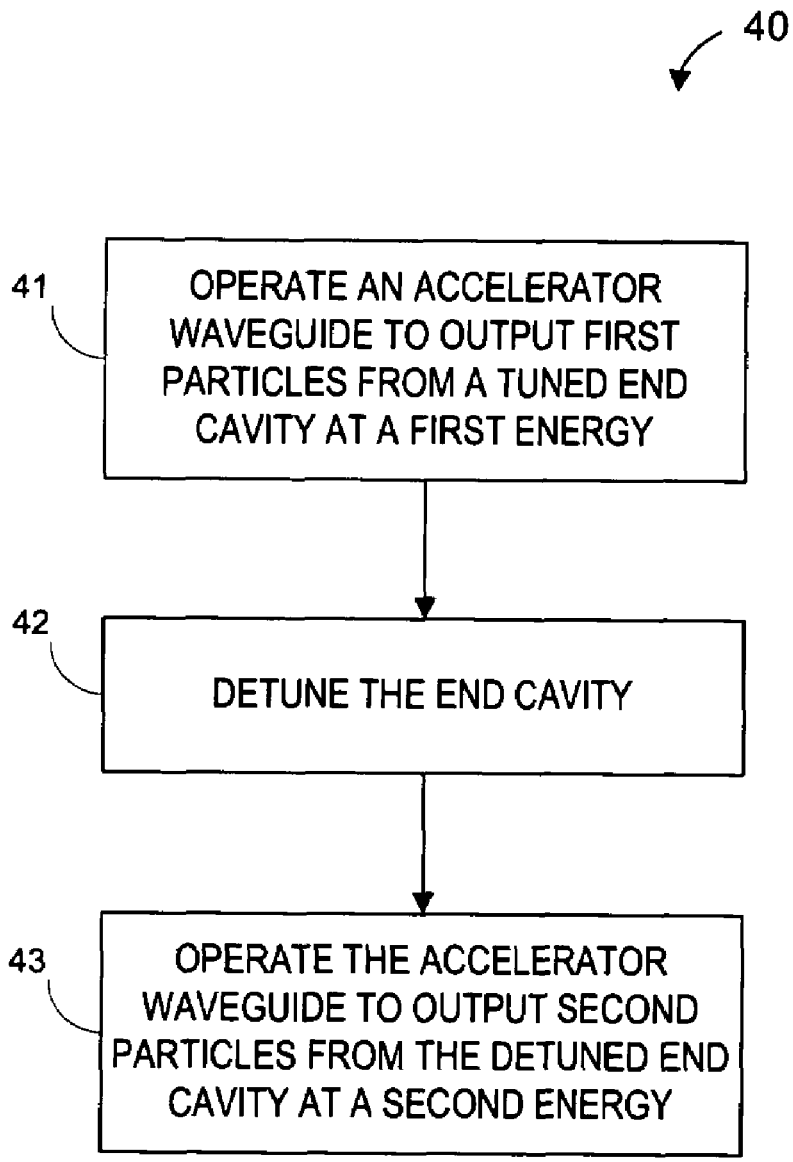
FIG. 2 is a flow diagram of process steps pursuant to some embodiments.

FIG. 2 is a flow diagram of process steps 40 according to some embodiments. Process steps 40 may be executed by one or more elements of particle accelerator 10, operator console 20, and other devices. Accordingly, process steps 40 may be embodied in hardware and/or software. Process steps 40 will be described below with respect to the above-described elements, however it will be understood that process steps 40 may be implemented and executed differently than as described below.

Prior to step 41, particle accelerator 10 may receive a command from console 20 to output first particles having a first energy. In response, accelerator waveguide 13 is operated to output first particles from a tuned end cavity at a first energy. Output of the first particles from a tuned end cavity at a first energy may be considered a first mode of operation.

Figure 3:
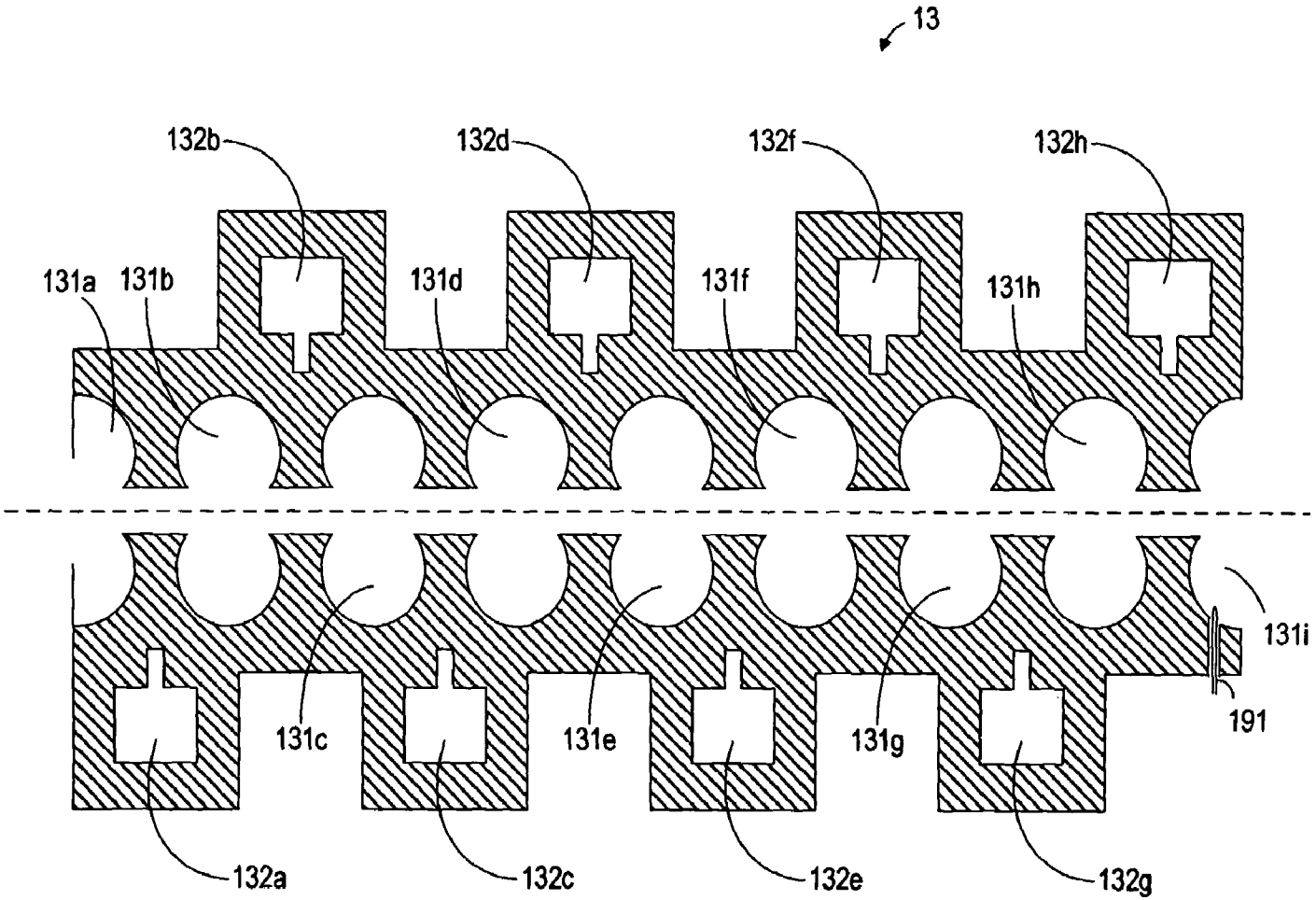
FIG. 3 is a cross-section of a linear accelerator according to some embodiments.

FIG. 3 is a cross-sectional view of accelerator waveguide 13 for describing step 41 according to some embodiments. Accelerator waveguide 13 has a plurality of primary cavities 131*a–i* disposed along a central axis. Primary cavities 131*a–i* are arranged and formed to accelerate particles along waveguide 13. Although not illustrated in FIG. 3, each of primary cavities 131*a–i* is coupled to RF power source 14 to receive an RF wave for accelerating the particles.

A plurality of side cavities 132*a–h* are also provided. Each side cavity is disposed between pairs of primary cavities to provide side coupling between primary cavities. For example, side cavity 132*b* provides coupling between primary cavities 131*b* and 131*c*. The design and arrangement of these cavities is known to those in the art.

Conductor loop 191 of detuning device 19 is coupled to end cavity 131*i* of waveguide 13. Conductor loop 191 may comprise an inner conductor of a coaxial cable that is formed into a loop. Conductor loop 191 may enter waveguide 13 through an opening that is thereafter sealed such that a vacuum may be maintained within waveguide 13.

A first few primary cavities of accelerator waveguide 13 may operate as a buncher to increase a phase velocity of the particle bunches to that of the received RF wave. Once the velocities are synchronized, the particle bunches will pass through each successive cavity during a time interval when the electric field intensity in the cavity is at a maximum. Each of cavities 131*a–i* may be designed and constructed to ensure that the particle bunches pass through each cavity during this time interval. Cavities possessing this characteristic are considered "tuned".

Figure 4:
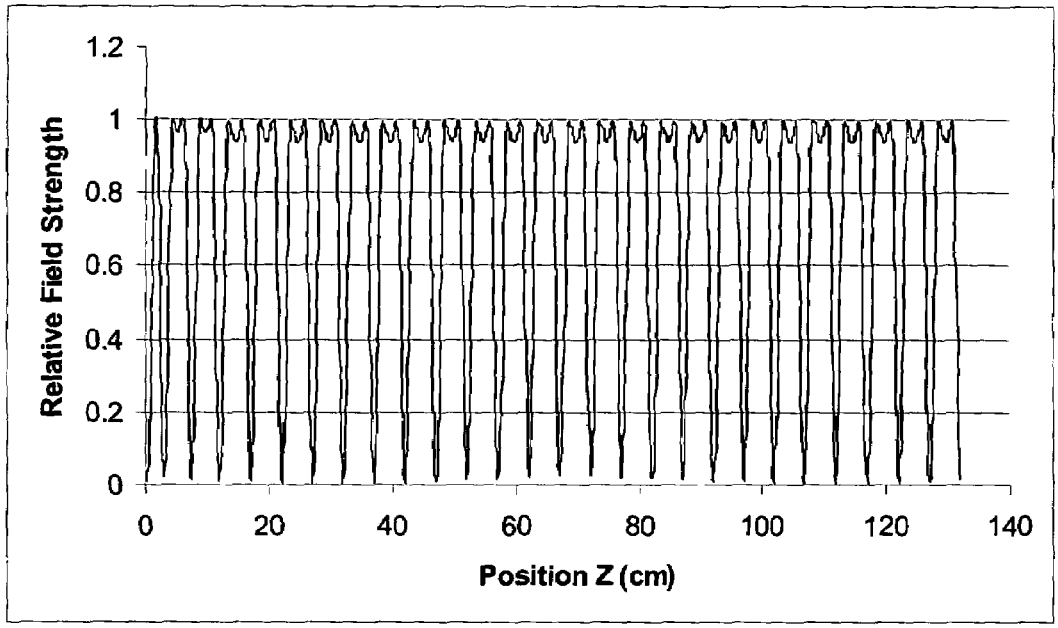
FIG. 4 is a graph illustrating an electric field distribution in an accelerator waveguide according to some embodiments.

In particular, end cavity 131*i* may be tuned at step 41 and particle bunches may therefore pass therethrough when the electric field intensity in cavity 131*i* is at a maximum. FIG. 4 illustrates a magnitude of an electric field within waveguide 13 when end cavity 131*i* is tuned and waveguide 13 is operated at step 41 according to some embodiments.

Figure 5:
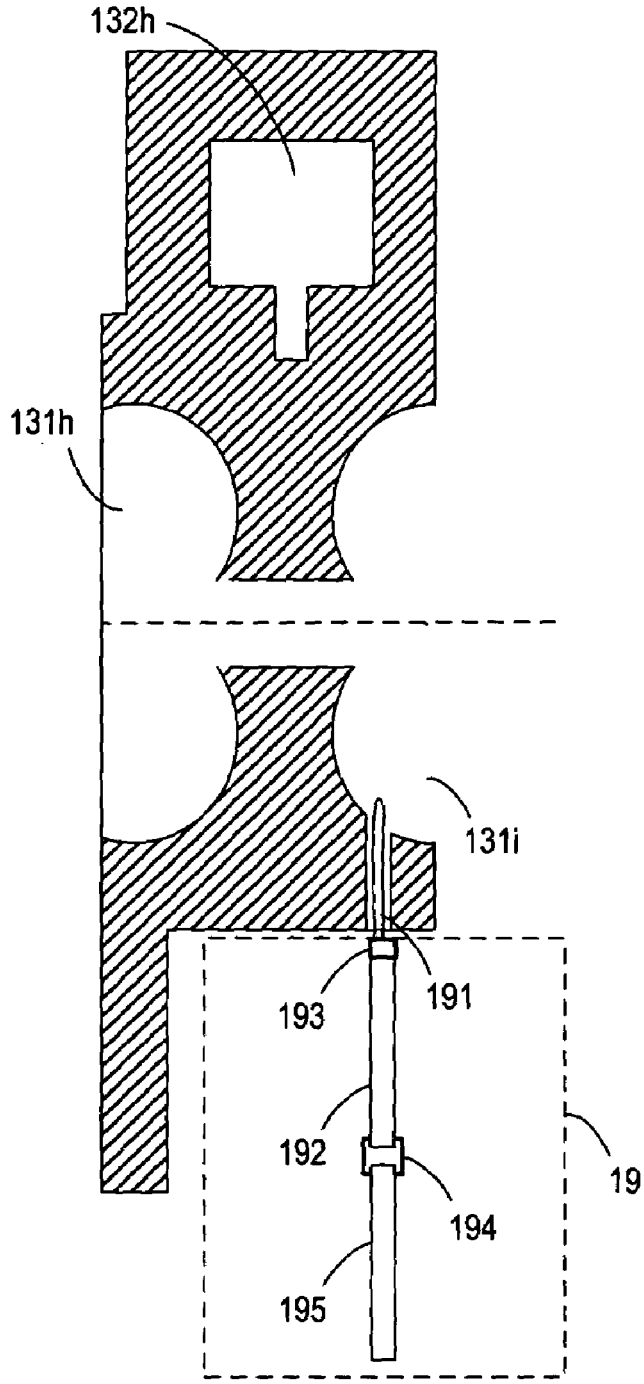
FIG. 5 is a cross-section of an accelerator waveguide according to some embodiments.

Next, end cavity 131*i* is detuned at step 42. FIG. 5 illustrates end cavity 131*i* and detuning device 19 according to some embodiments. Detuning device 19 of FIG. 5 comprises an electrical circuit. A characteristic of the electrical circuit may be controlled so as to selectively detune end cavity 131*i*.

More specifically, detuning device 19 of FIG. 5 comprises conductor loop 191 as described above and coaxial cable 192. Conductor loop 191 emerges from coaxial cable 192 and returns to be coupled to conductive sleeve 193 of coaxial cable 192. Detuning device 19 also comprises switch 194 and coaxial cable 195. Control unit 18 may control switch 194 to selectively couple coaxial cable 192 to coaxial cable 195. Switch 194 may comprise any suitable switch, including but not limited to a ferrite switch and a PIN diode switch.

At step 42, switch 194 may be controlled to couple coaxial cable 195 to coaxial cable 192, thereby coupling coaxial cable 195 to conductor loop 191 and to end cavity 131*i*. Coupling coaxial cable 195 to coaxial cable 192 may change a characteristic of the electrical circuit of device 19, such as the impedance of the electrical circuit. The changed characteristic may detune end cavity 131*i* by changing a resonant frequency thereof. Other characteristics of the electrical circuit may be changed to detune end cavity 131*i* according to some embodiments. According to some embodiments, end cavity 131*i* is tuned in a case that coaxial cable 195 is coupled to coaxial cable 192 and is detuned in a case that coaxial cable 195 is not coupled to coaxial cable 192.

A command may be received by control unit 18 from console 20 prior to step 42 to output second particles having a second energy. In response, control unit may automatically control switch 194 to detune end cavity 131*i* at step 42.

Accelerator waveguide 13 is operated at step 43 to output second particles having a second energy. Such operation may comprise changing the current of the beam emitted by particle source 12 and/or the power of the RF wave emitted by RF power source 14 to correspond to the second energy. Operation of the accelerator waveguide at the second energy may be considered a second mode of operation.

Figure 6:
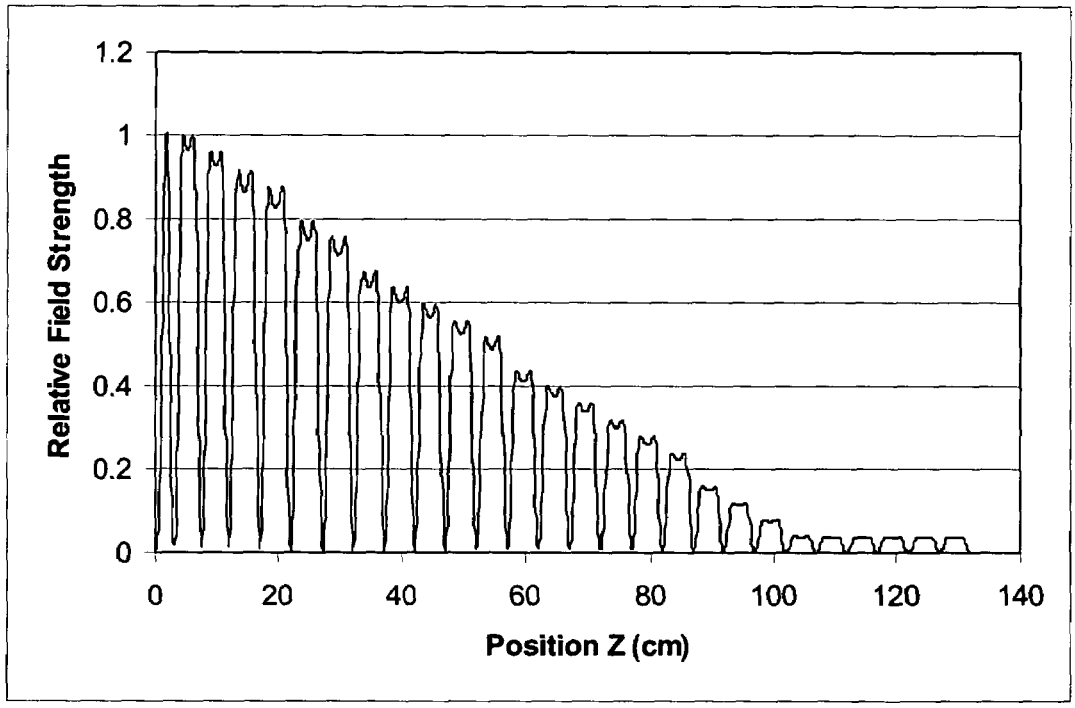
FIG. 6 is a graph illustrating an electric field distribution in an accelerator waveguide according to some embodiments.

FIG. 6 illustrates a magnitude of an electric field within waveguide 13 when end cavity 131*i* is detuned and waveguide 13 is operated at step 43 according to some embodiments. The magnitude of the electric field shown in FIG. 6 drops significantly towards end cavity 131*i* in comparison to the magnitude shown in FIG. 4. This drop in magnitude may cause the particles that are accelerated at step 43 to experience a smaller energy gain than the particles that are accelerated at step 41. In some embodiments, the capture efficiency of accelerator waveguide 13 at step 43 is substantially equal to the capture efficiency at step 41 due to the similar electric field magnitudes at the input (buncher) cavities of waveguide 13.

Figure 7:
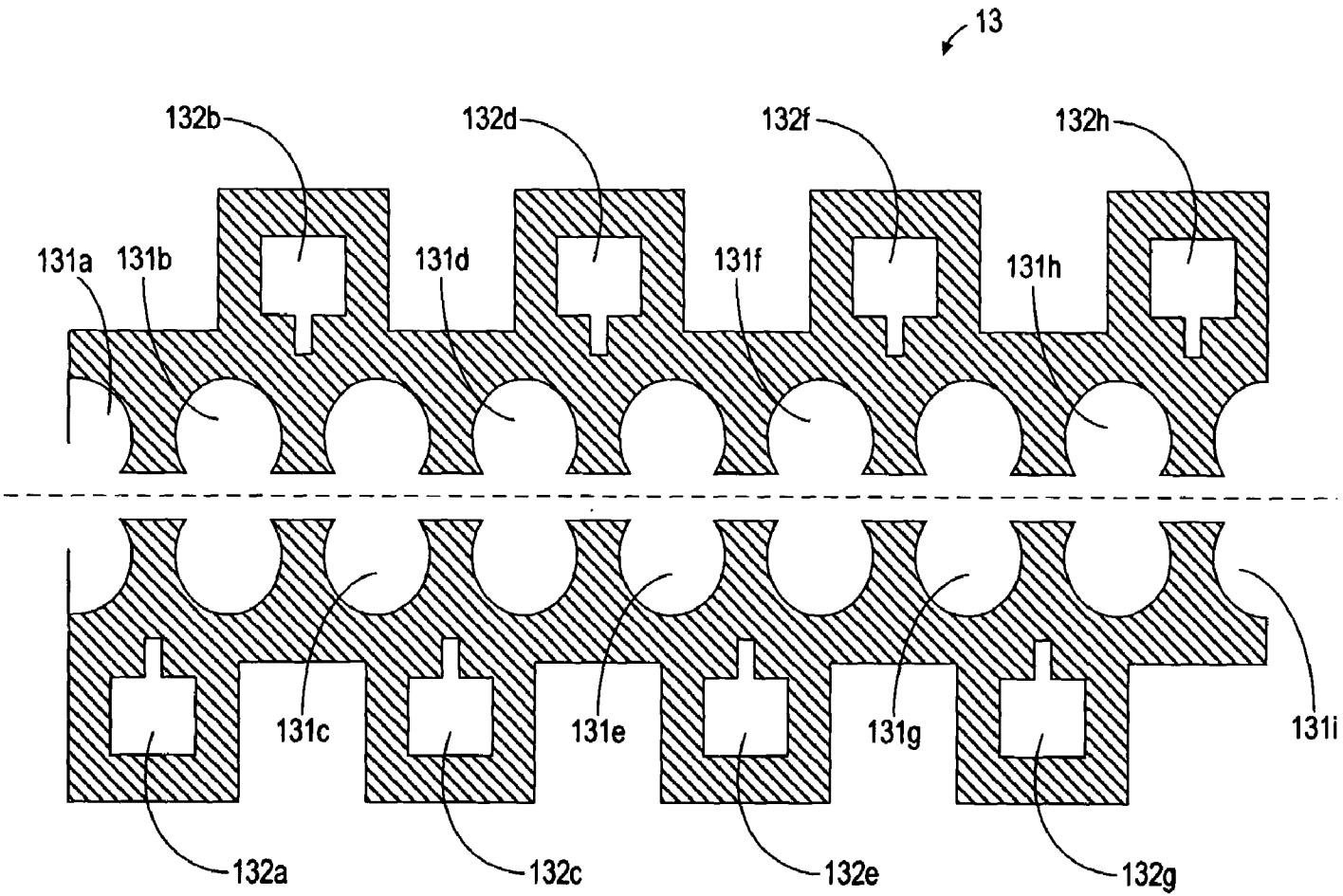
FIG. 7 is a cross-section of a linear accelerator according to some embodiments.

FIG. 7 is a cross-sectional view of waveguide 13 according to some embodiments of step 41. Waveguide 13 of FIG. 7 is configured and operated conventionally to output first particles at a first energy in a first mode. In the illustrated embodiment, end cavity 131*i* is tuned such that the first particle bunches pass therethrough when the electric field intensity in cavity 131*i* is at a maximum.

Figure 8:
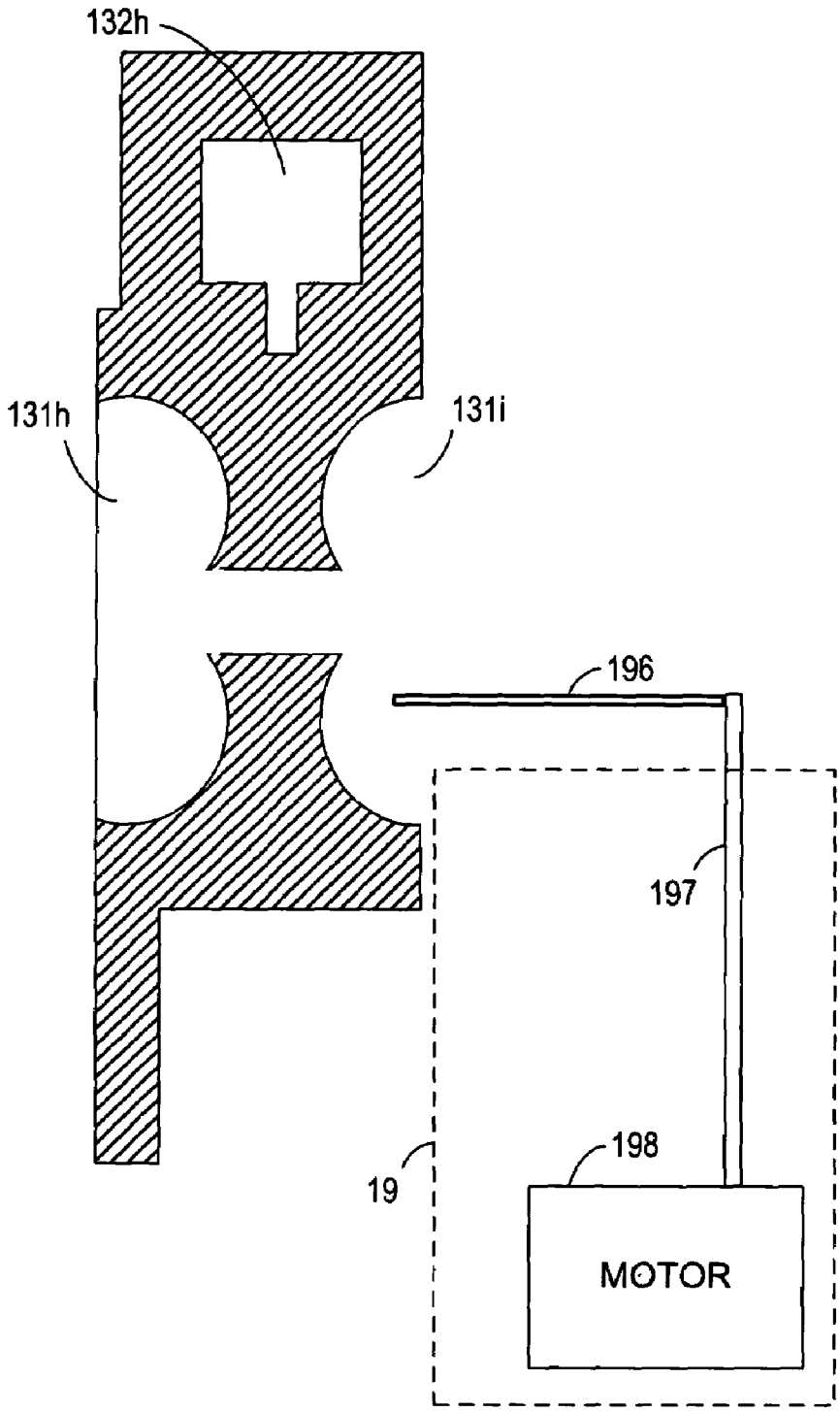
FIG. 8 is a cross-section of an accelerator waveguide according to some embodiments.

FIG. 8 illustrates detuning device 19 to detune end cavity 131*i* of FIG. 7 at step 42 according to some embodiments. Detuning device 19 of FIG. 8 comprises probe 196, arm 197, and motor 198. Probe 196 may comprise any material that is capable of detuning end cavity 131*i* by virtue of its presence therein.

In some embodiments of step 42, motor 198 moves arm 197 to move probe 196 from a first position to a second position within end cavity 131*i*. Motor 198 may move arm 197 in response to an instruction received from control unit 18 prior to step 42. In some embodiments, probe 196 enters end cavity 131*i* through a sidewall of waveguide 13. According to some embodiments, end cavity 131*i* is detuned in a case that probe 196 is not within end cavity 131*i* (as shown in FIG. 7), and is tuned in a case that probe 196 is disposed within end cavity 131*i*.

Any other suitable system may be used to detune an end cavity according to some embodiments of step 42. Some embodiments may enable efficient production of particles having multiple output energies from a single particle accelerator.

Those in the art will appreciate that various adaptations and modifications of the above-described embodiments can be configured without departing from the scope and spirit of the claimed invention. Therefore, it is to be understood that, within the scope of the appended claims, the claimed invention may be practiced other than as specifically described herein.

What is claimed is:

1. An apparatus comprising:

an accelerator waveguide comprising an end accelerating cavity, the accelerator waveguide to output first particles from the end accelerating cavity at a first energy in a first mode and to output second particles from the end accelerating cavity at a second energy in a second mode; and a detuning device coupled to the end accelerating cavity, the detuning device to selectively detune the end accelerating cavity.

2. The apparatus according to claim 1, the detuning device comprising:

a probe movable between a first position in the first mode and a second position within the end accelerating cavity in the second mode.

3. The apparatus according to claim 1, the detuning device comprising:

an electrical circuit including an electrical conductor, a portion of the electrical conductor disposed within the end accelerating cavity.

4. The apparatus according to claim 3, wherein a characteristic of the electrical circuit is controllable to selectively detune the end accelerating cavity.

5. The apparatus according to claim 3, the electrical circuit comprising:

a first coaxial cable coupled to the electrical conductor;

a second coaxial cable; and a switch to selectively couple the first coaxial cable to the second coaxial cable.

6. The apparatus according to claim 1, further comprising:

an RF power source to transmit a first wave having a first power to the accelerator waveguide in the first mode, and to transmit a second wave having a second power to the accelerator waveguide in the second mode.

7. The apparatus according to claim 1, further comprising:

a particle source to inject particles at a first current into the accelerator waveguide in the first mode, and to inject particles at a second current into the accelerator waveguide in the second mode.

8. The apparatus according to claim 1, further comprising:

a control unit to receive an instruction to switch from the first mode to the second mode, and to control the detuning device to detune the end accelerating cavity in response to the instruction.

9. A method comprising:

operating an accelerator waveguide to output first particles from a tuned end accelerating cavity of the accelerator waveguide at a first energy;

detuning the end accelerating cavity; and operating the accelerator waveguide to output second particles from the detuned end accelerating cavity at a second energy.

10. The method according to claim 9, wherein detuning the end accelerating cavity comprises:

changing a resonant frequency of the end accelerating cavity.

11. The method according to claim 9, wherein detuning the end accelerating cavity comprises:

moving a probe to a position within the end accelerating cavity.

12. A method according to claim 9, wherein detuning the end accelerating cavity comprises:

changing an electrical characteristic of a circuit coupled to the end accelerating cavity.

13. The method according to claim 12, wherein the electrical characteristic is an impedance of the circuit.

14. The method according to claim 12, wherein changing the electrical characteristic of the circuit comprises:

coupling a coaxial cable to the end accelerating cavity.

15. The method according to claim 9, wherein operating the accelerator waveguide to output first particles from the tuned end accelerating cavity at the first energy comprises:

operating an RF power source to deliver a wave having a first power to the accelerator waveguide, and wherein operating the accelerator waveguide to output second particles from the detuned end accelerating cavity at the second energy comprises:

operating the RF power source to deliver a wave having a second power to the accelerator waveguide.

16. A method according to claim 9, wherein operating the accelerator waveguide to output first particles from the tuned end accelerating cavity at the first energy comprises:

operating a particle source to inject particles at a first current into the accelerator waveguide, and wherein operating the accelerator waveguide to output second particles from the detuned end accelerating cavity at the second energy comprises:

operating the particle source to inject particles at a second current into the accelerator waveguide.

17. The method according to claim 9, further comprising:

receiving an instruction to switch between operation of the accelerator waveguide at the first energy and operation of the accelerator waveguide at the second energy; and automatically detuning the end accelerating cavity in response to the instruction.

18. A medium storing processor-executable process steps, the steps comprising:

a step to operate an accelerator waveguide to output first particles from a tuned end accelerating cavity of the accelerator waveguide at a first energy;

a step to detune the end accelerating cavity; and a step to operate the accelerator waveguide to output second particles from the detuned end accelerating cavity at a second energy.

19. The medium according to claim 18, wherein detuning the end accelerating cavity comprises:

a step to change a resonant frequency of the end accelerating cavity.

20. The medium according to claim 18, wherein detuning the end accelerating cavity comprises:

a step to move a probe to a position within the end accelerating cavity.

21. The medium according to claim 18, wherein detuning the end accelerating cavity comprises:

a step to change an electrical characteristic of a circuit coupled to the end accelerating cavity.

22. The medium according to claim 21, wherein the electrical characteristic is an impedance of the circuit.

23. The medium according to claim 21, wherein the step to change the electrical characteristic of the circuit comprises:

a step to couple a second coaxial cable to the end accelerating cavity.

24. The medium according to claim 18, wherein the step to operate the accelerator waveguide to output first particles from the tuned end accelerating cavity at the first energy comprises:

a step to operate an RF power source to deliver a wave having a first power to the accelerator waveguide, and wherein the step to operate the accelerator waveguide to output second particles from the detuned end accelerating cavity at the second energy comprises:

a step to operate the RF power source to deliver a wave having a second power to the accelerator waveguide.

25. The medium according to claim 18, wherein the step to operate the accelerator waveguide to output first particles from the tuned end accelerating cavity at the first energy comprises:

a step to operate a particle source to inject particles at a first current into the accelerator waveguide, and wherein the step to operate the accelerator waveguide to output second particles from the detuned end accelerating cavity at the second energy comprises:

a step to operate the particle source to inject particles at a second current into the accelerator waveguide.

26. The medium according to claim 18, further comprising:

a step to receive an instruction to switch between operation of the accelerator waveguide at the first energy and operation of the accelerator waveguide at the second energy; and a step to automatically detune the end accelerating cavity in response to the instruction.

* * * * *